US007292221B2

(12) United States Patent
Woo

(10) Patent No.: US 7,292,221 B2
(45) Date of Patent: Nov. 6, 2007

(54) APPARATUS AND METHOD FOR CONTROLLING INVERTER PULSE WIDTH MODULATION FREQUENCY IN LCD IN PORTABLE COMPUTER

(75) Inventor: Jong Hyun Woo, Pyungtaek-si (KR)

(73) Assignee: LG Electronics Inc., Seoul (KR)

( * ) Notice: Subject to any disclaimer, the term of this patent is extended or adjusted under 35 U.S.C. 154(b) by 644 days.

(21) Appl. No.: 10/803,037

(22) Filed: Mar. 18, 2004

(65) Prior Publication Data

US 2004/0183821 A1 Sep. 23, 2004

(30) Foreign Application Priority Data

Mar. 20, 2003 (KR) ..... 10-2003-0017603
May 29, 2003 (KR) ..... 10-2003-0034498

(51) Int. Cl.
*G09G 3/36* (2006.01)
*G09G 5/00* (2006.01)

(52) U.S. Cl. ..... 345/102; 345/204; 345/211; 345/212; 345/213

(58) Field of Classification Search ..... 345/204, 345/211, 212, 213
See application file for complete search history.

(56) References Cited

U.S. PATENT DOCUMENTS

| | | | | |
|---|---|---|---|---|
| 5,786,801 | A * | 7/1998 | Ichise | 345/102 |
| 5,939,830 | A | 8/1999 | Praiswater | 315/DIG. 4 |
| 6,445,143 | B1 | 9/2002 | Min | 315/307 |
| 6,961,044 | B2 * | 11/2005 | Woo | 345/102 |
| 2004/0008176 | A1 * | 1/2004 | Nuimura | 345/102 |

* cited by examiner

*Primary Examiner*—Richard Hjerpe
*Assistant Examiner*—My-Chau T. Tran
(74) *Attorney, Agent, or Firm*—Ked & Associates, LLP

(57) ABSTRACT

Apparatus and methods according to embodiments of the present invention can control an inverter pulse width modulation (PWM) frequency of a liquid crystal display (LCD) in a portable computer or the like. Noise and/or interference caused by a system environment can be detected and one of a plurality of LCD frame frequencies can be selected responsive to the system environment. Interference between a PWM frequency of an inverter can be reduced or prevented by identifying a desired PWM frequency of the inverter adapted to control a brightness of the LCD based on the selected LCD frame frequency or the like, and driving the LCD using the same.

31 Claims, 11 Drawing Sheets

FIG. 4

*Extended Display Identification Data (EDID)*

| Address | No. bytes | | Description |
|---|---|---|---|
| 00h | 1 | Bytes | EDID Structure Version / Revision |
| 01h | 7 | Bytes | Vendor / Product Identification |
| 01h | | 2 | ID Manufacture |
| ⋮ | ⋮ | ⋮ | ⋮ |
| 80h | 127 | Bytes | Luminance Table & Timing Descriptions |
| * | | x*A | Luminance Table |
| * | | 8*B | Range Limits |
| * | | 27*C | 27-Byte - Detailed Range Limits |
| * | | 4*D | 4-Byte Timing Codes |
| * | | 18*E | 18-byte Detailed Timing Descriptions |
| * | | X | X=127 - (x*A+8*B+27*C+4*D+18*D) |
| FFh | 1 | Byte | Checksum |

FIG. 5

*Display timing range limits*

| 8 | Bytes | Bit | Description |
|---|---|---|---|
| | 1 | 7-0 | Min Frame / field rate in Hz |
| | 1 | 7-0 | Max Frame / field rate in Hz |
| | 1 | 7-0 | Min line rate in kHz |
| | 1 | 7-0 | Max line rate in kHz |
| | 1 | 7-0 | Lower bits frame / field & line rate |
| | 1 | 7-0 | Min pixel rate in MHz |
| | 1 | 7-0 | Max pixel rate in MHz |
| | 1 | 7-4 | Upper bits min pixel rate |
| | | 3-0 | Upper bits min pixel rate |

FIG. 7

| LCD Refresh Rate | Output PWM | LCD Refresh Rate | Output PWM | LCD Refresh Rate | Output PWM |
|---|---|---|---|---|---|
| 60 | 270 | 53 | 238.5 | 46 | 207 |
| 59 | 265.5 | 52 | 234 | 45 | 202.5 |
| 58 | 261 | 51 | 229.5 | 44 | 198 |
| 57 | 256.5 | 50 | 225 | 43 | 193.5 |
| 56 | 252 | 49 | 220.5 | 42 | 189 |
| 55 | 247.5 | 48 | 216 | 41 | 184.5 |
| 54 | 243 | 47 | 211.5 | 40 | 180 |

FIG. 11

| LCD Refresh Rate | Optimum PWM | DC Voltage | Output PWM |
|---|---|---|---|
| | | | |
| | | 3.300 | 272.0 |
| 60 | 270 | 3.248 | 270.5 |
| | | 3.197 | 269.0 |
| | | 3.145 | 267.5 |
| 59 | 265.5 | 3.094 | 265.9 |
| | | 3.042 | 264.4 |
| | | 2.991 | 262.9 |
| 58 | 261 | 2.939 | 261.4 |
| | | 2.888 | 259.9 |
| | | 2.836 | 258.4 |
| 57 | 256.5 | 2.784 | 256.8 |
| | | 2.733 | 255.3 |
| | | 2.681 | 253.8 |
| 56 | 252 | 2.630 | 252.3 |
| | | 2.578 | 250.8 |
| | | 2.527 | 249.3 |
| 55 | 247.5 | 2.475 | 247.8 |
| | | 2.423 | 246.2 |
| | | 2.372 | 244.7 |
| 54 | 243 | 2.320 | 243.2 |
| | | 2.269 | 241.7 |
| | | 2.217 | 240.2 |

| LCD Refresh Rate | Optimum PWM | DC Voltage | Output PWM |
|---|---|---|---|
| | | | |
| | | | |
| 53 | 238.5 | 2.166 | 238.7 |
| | | 2.114 | 237.1 |
| | | 2.063 | 235.6 |
| 52 | 234 | 2.011 | 234.1 |
| | | 1.959 | 232.6 |
| | | 1.908 | 231.1 |
| 51 | 229.5 | 1.856 | 229.6 |
| | | 1.805 | 228.0 |
| | | 1.753 | 226.5 |
| 50 | 225 | 1.702 | 225.0 |
| | | 1.650 | 223.5 |
| | | 1.599 | 222.0 |
| 49 | 220.5 | 1.547 | 220.5 |
| | | 1.495 | 219.0 |
| | | 1.444 | 217.4 |
| 48 | 216 | 1.392 | 215.9 |
| | | 1.341 | 214.4 |
| | | 1.289 | 212.9 |
| 47 | 211.5 | 1.238 | 211.4 |
| | | 1.186 | 209.9 |
| | | 1.134 | 208.3 |

| LCD Refresh Rate | Optimum PWM | DC Voltage | Output PWM |
|---|---|---|---|
| | | | |
| | | | |
| 46 | 207 | 1.083 | 206.8 |
| | | 1.031 | 205.3 |
| | | 0.980 | 203.8 |
| 45 | 202.5 | 0.928 | 202.3 |
| | | 0.877 | 200.8 |
| | | 0.825 | 199.3 |
| 44 | 198 | 0.774 | 197.7 |
| | | 0.722 | 196.2 |
| | | 0.670 | 194.7 |
| 43 | 193.5 | 0.619 | 193.2 |
| | | 0.567 | 191.7 |
| | | 0.516 | 190.2 |
| 42 | 189 | 0.464 | 188.6 |
| | | 0.413 | 187.1 |
| | | 0.361 | 185.6 |
| 41 | 184.5 | 0.310 | 184.1 |
| | | 0.258 | 182.6 |
| | | 0.206 | 181.1 |
| 40 | 180 | 0.155 | 179.5 |
| | | | |
| | | | |

APPARATUS AND METHOD FOR CONTROLLING INVERTER PULSE WIDTH MODULATION FREQUENCY IN LCD IN PORTABLE COMPUTER

BACKGROUND OF THE INVENTION

1. Field of the Invention

The present invention relates to an apparatus and method adapted to control the brightness of a display such as a liquid crystal display (LCD) in a portable computer.

2. Background of the Related Art

Products directly using an LCD as a display unit include a desktop computer and various portable appliances such as a notebook computer and a personal digital assistant (PDA). Portable appliances such as a notebook computer and a PDA have an important object to reduce or minimize the consumption of electric power.

FIG. 1 schematically illustrates the configuration of a related art portable computer, for example, a notebook computer. As shown in FIG. 1, a notebook computer includes a central processing unit (CPU) 10, a video controller 11, a host-PCI bridge 12, a memory 13, a video RAM 14, an audio controller 15, a LAN controller 16, a card bus controller 17, a PCI-ISA bridge 18, an LCD 19, a microcomputer (micom) 20, and a keyboard 21, all of which are connected by bus lines.

The PCI-ISA bridge 18 includes a CMOS-RAM 180. The microcomputer 20 includes a ROM 200, a RAM 201, and a keyboard controller 203.

As shown in FIG. 2, the LCD 19 is provided with a light emitting element 190 such as a cold cathode fluorescent lamp (CCFL) at a lower or upper portion thereof. The notebook computer also includes a unit for controlling the brightness of the LCD 19. The brightness controlling unit includes a power supply unit 30 and an inverter 33. The power supply unit 30 is for transforming a voltage supplied from a battery 31 or an AC adapter 32 into a predetermined level, and supplying the voltage of the predetermined level. The inverter 33 is for converting the voltage of the predetermined level supplied from the power supply unit 30 into a signal having a waveform synchronized to a PWM signal, and applying the converted signal to the CCFL 190.

The PWM signal, which is inputted to the inverter 33 from the microcomputer 20, may be set to have a fixed frequency from 100 Hz to 400 Hz, for example, 210 Hz. In this case, the inverter 33 outputs a signal having a waveform synchronized to the frequency of 210 Hz. The output signal from the inverter 33 is applied to the CCFL 190 of the LCD 19, so that the brightness of the LCD 19 is maintained at a certain level. For brightness control, the inverter 33 receives information about the on-time duty at the selected frequency, adjusted in a range of 0 to 100% in accordance with a desired level of brightness.

Thus, the inverter 33 converts the predetermined voltage level supplied from the power supply unit 30 into a signal having a frequency and on-time duty synchronized to the PWM signal outputted from the microcomputer 20, and outputs the resultant signal to the CCFL 190 to control the brightness of the LCD 19. In operation, however, the frequency of the signal outputted from the inverter 33 in sync with the PWM signal may interfere with the frame frequency of the LCD 19 so that noise appears on the screen of the LCD.

Accordingly, the PWM frequency of the inverter is generally set based upon the frame frequency of the LCD. Typically, the PWM frequency is set to be higher than the n-th multiple (n times) of the frame frequency, that is, a vertical sync (Vsync) frequency, by 20 to 30 Hz. If the difference between the PWM frequency and the n-multiple of the frame frequency is less than 20 Hz, the possibility increases that noise appears on the LCD because of frequency interference.

The noise generation occurrence caused by frequency interference can be represented by an expression of "f=ABS [PWM Frequency−(Frame Frequency×n)] (where n=1, 2, 3, 4, . . . ). In this expression, "f≧15" corresponds to a stable state, and "f<15" corresponds to an instable state.

Accordingly, where the frame frequency of the LCD, that is, the Vsync frequency, is 60 Hz, appropriate PWM frequency ranges may be as follows: (60*1)+20~30=80~90; (60*2)+20~30=140~150; (60*3)+20~30=200~210; (60*4)+20~30=260~270; (60*5)+20~30=320~330; and (60*6)+20~30=380~390. Respective central frequency values of these frequencies, that is, 90 Hz, 150 Hz, 210 Hz, 270 Hz, . . . may be used as optimal setting values for a PWM frequency. In particular, 210 Hz or 270 Hz are used as a PWM frequency. With respect to a central frequency value of 270 Hz, a frequency range of 255 Hz to 285 Hz can be considered a stable PWM frequency range for the LCD with a frame frequency of 60 Hz. Where an LCD using a single fixed Vsync frequency, for example, an LCD in which only a Vsync frequency of 60 Hz is allowed for the same kind (e.g., model) of portable computers, its PWM frequency may be set in accordance with the above-described manner.

However, the related art apparatus and methods for controlling brightness of an LCD, for example, in a portable computer have various disadvantages. Where different LCDs using different Vsync frequencies of, for example, 50 Hz, 56 Hz, and 60 Hz (or 45 Hz, 57 Hz and 60 Hz), are used for portable computers of the same model, it is difficult or impossible to select a PWM frequency for all the LCDs. As a result, noise may be generated in a particular one of the LCDs. For example, where the PWM frequency is fixed at 210 Hz to meet a Vsync frequency of 60 Hz, the LCDs using a Vsync frequency of 50 Hz or 56 Hz involve generation of noise caused by frequency interference because the difference between a multiple of the Vsync frequency and the PWM frequency of 210 Hz corresponds to 10 Hz or 14 Hz (f<20). Thus, when related art notebook computers are configured to control the frame frequency of an LCD, degradation in picture quality can occur because of interference between the frame frequency of the LCD and the PWM frequency for controlling the brightness of the LCD.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Another object of the present invention is to provide an apparatus and method for controlling an inverter PWM frequency adapted to control the brightness of an LCD in association with a frame frequency of the LCD.

Another object of the present invention is to provide an apparatus and method for controlling an inverter PWM frequency of an inverter adapted to control the brightness of an LCD in a portable computer that can set a prescribed inverter PWM frequency causing reduced frequency interference.

Another object of the invention is to provide an apparatus and method for controlling an inverter PWM frequency adapted to control the brightness of an LCD that are capable of driving the LCD at a selected or optimal PWM frequency using a single inverter even when the LCD is allowed to use various frame frequencies.

Another object of the invention is to provide an apparatus and method for controlling an inverter PWM frequency adapted to control the brightness of an LCD by automatically adjusting the PWM frequency to a selected one of a plurality of frequencies causing reduced frequency interference.

Another object of the present invention is to provide an apparatus and method configured to control an inverter PWM frequency adapted to control the brightness of an LCD in a portable computer that can set a prescribed inverter PWM frequency causing reduced frequency interference using a vertical sync frequency included in extended display identification data (EDID) for the LCD.

Another object of the present invention is to provide an apparatus and method for controlling PWM frequency for various kinds of LCDs used in the same model of portable computers, which can drive using prescribed frequencies respective light emitting elements of the LCDs using a single inverter.

In order to achieve at least the above objects and advantages in whole or in part, there is provided an apparatus for controlling pulse width modulation (PWM) frequency of a liquid crystal display (LCD) that includes a control unit for a changed LCD frame frequency of the LCD according to a system environment, and outputting information based on the changed LCD frame frequency for an LCD inverter, a PWM converting unit for generating a PWM signal of the LCD inverter based on the information received from the control unit and a driving unit for converting an input voltage into a signal having a waveform synchronized to the PWM signal received from the PWM converting unit.

To further achieve at least the above objects and advantages in whole or in part, there is provided a method for controlling an inverter pulse width modulation (PWM) frequency of a liquid crystal display (LCD) that includes identifying a frame frequency of the LCD, and outputting PWM information based on the identified frame frequency and generating a PWM signal, based on the PWM information and brightness control information for an LCD lamp.

To further achieve at least the above objects and advantages in whole or in part, there is provided an apparatus configured to control an inverter pulse width modulation (PWM) frequency of a liquid crystal display (LCD) that includes a controller configured to select each of a plurality of different frame frequencies of the LCD based on a system environment and output PWM information based on the selected frame frequency for an LCD lamp and a PWM converter configured to generate a PWM signal based on the PWM information.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIGS. 4 and 5 are schematic diagrams illustrating, in the form of a table, exemplary extended display identification data (EDID);

FIG. 7 is a diagram illustrating a table of exemplary values that can be used for the apparatus of FIG. 3;

FIG. 11 is a diagram illustrating a table of exemplary values that can be used by the apparatus of FIG. 8.

DETAILED DESCRIPTION OF PREFERRED EMBODIMENTS

Figure 1:
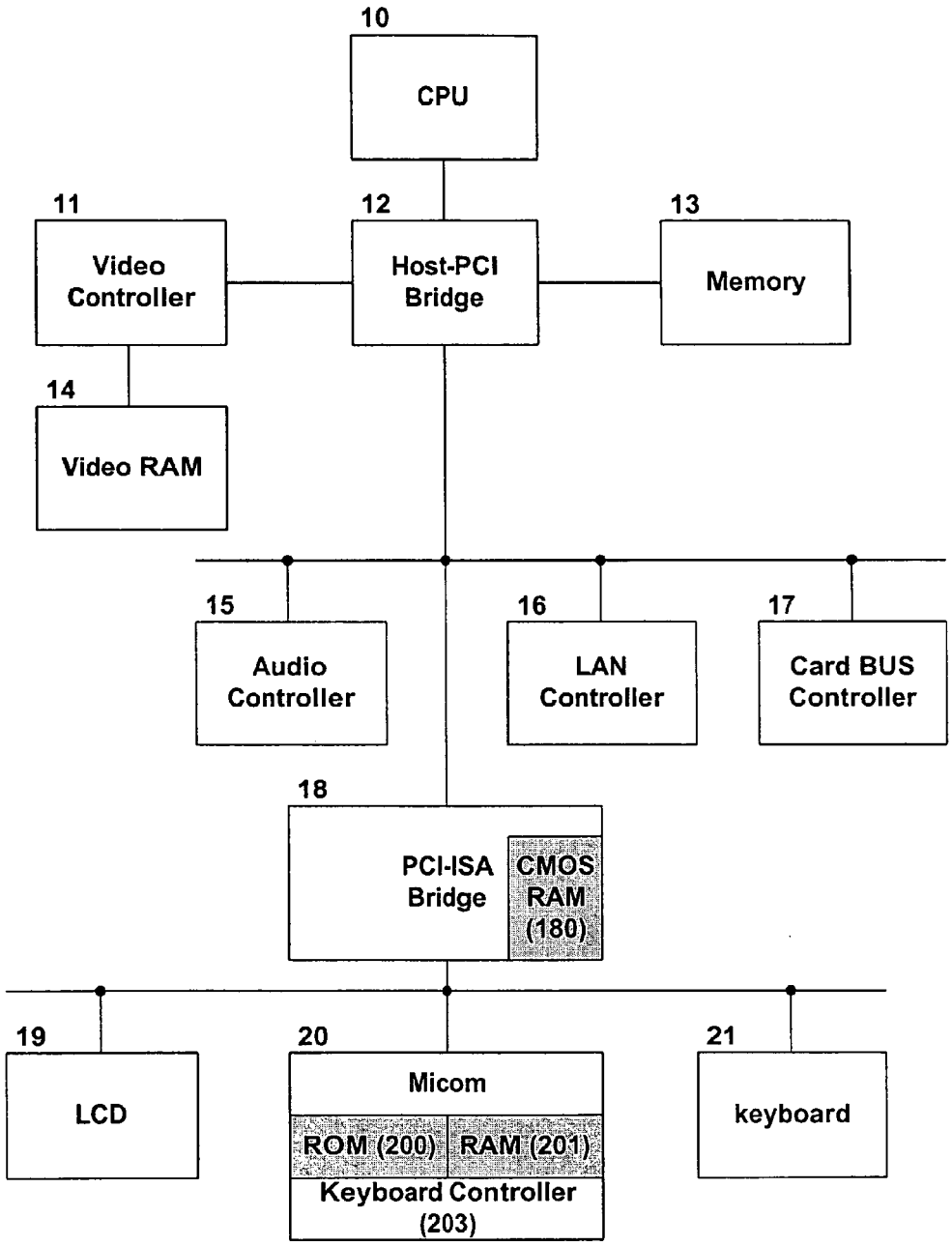
FIG. 1 (Related Art)
FIG. 1 is a block diagram illustrating a configuration of a related art portable computer.
Figure 2:
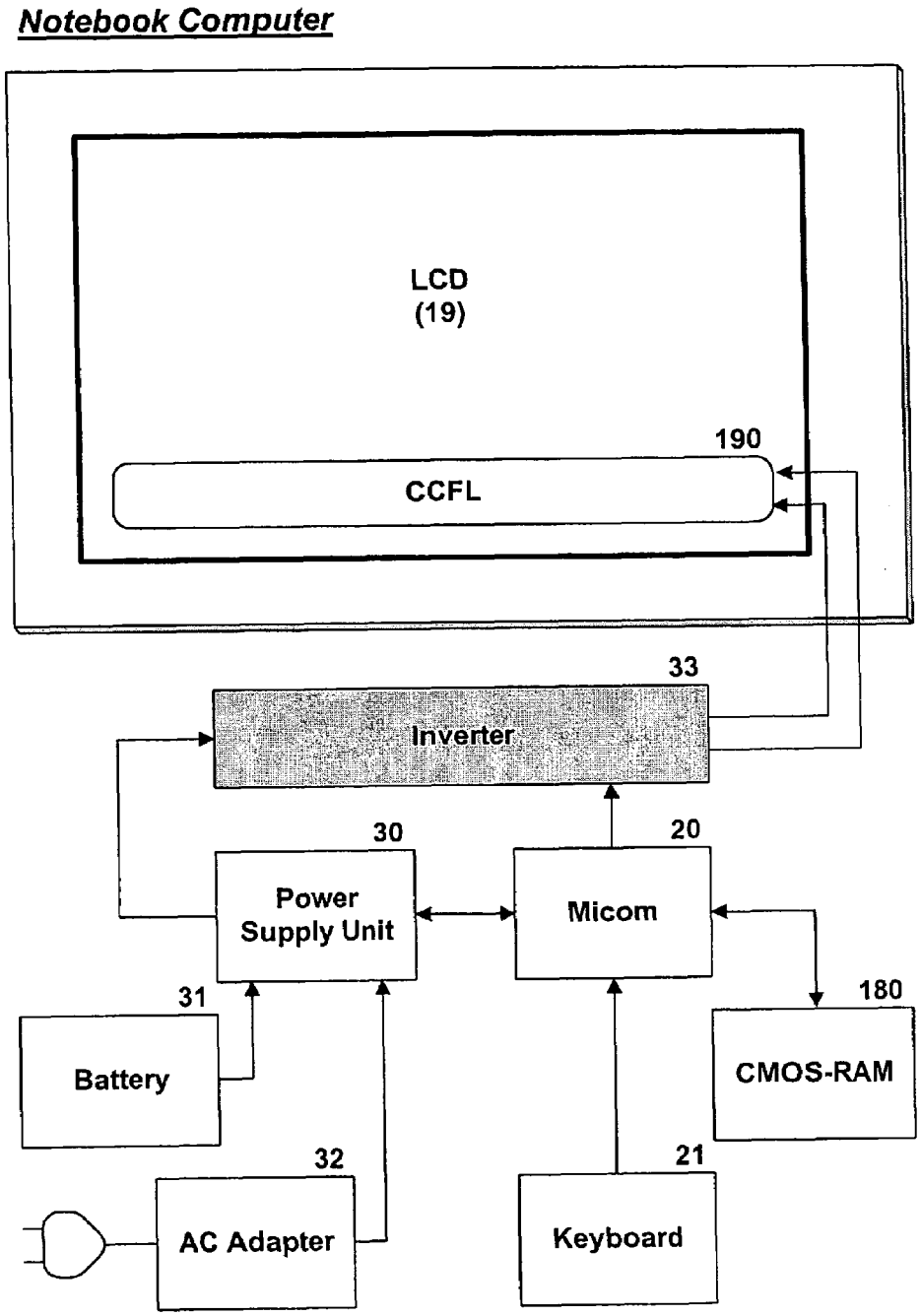
FIG. 2 (Related Art)
FIG. 2 is a block diagram illustrating an LCD brightness controlling apparatus in a related art portable computer.
Figure 3:
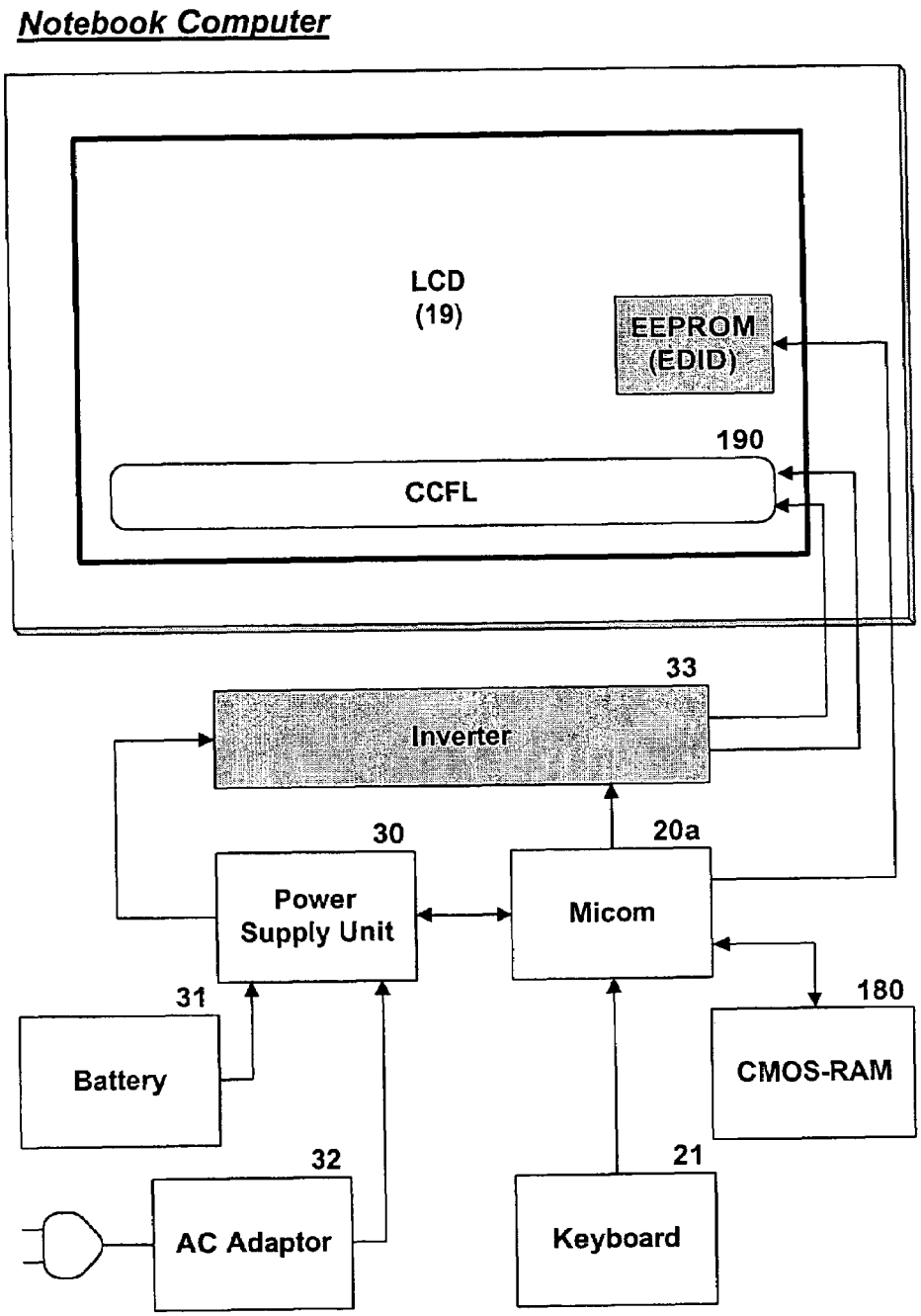
FIG. 3 is a block diagram illustrating a preferred embodiment of an apparatus that controls brightness in a display of a portable computer in accordance with the present invention.

Embodiments of an inverter PWM frequency controlling apparatus and method according to the present invention can be applied to a portable computer. For example, embodiments according to the present invention can be applied to a notebook computer having a configuration as shown in FIG. 3. An LCD of the notebook computer is provided with an EEPROM, which can be a non-volatile memory. The EEPROM can store extended display identification data (EDID) for the LCD.

As shown in FIGS. 4 and 5, exemplary EDID contains information about display timing range limits including LCD frame frequencies. As shown in FIG. 5, "Min Frame/field rate in Hz" preferably represents a minimum or lower frame frequency, whereas "Max Frame/field rate in Hz" preferably represents a maximum or higher frame frequency. The LCD frame frequencies included in the display timing range limit information may be expressed by the minimum and maximum frame frequencies as shown in FIG. 5. However, the present invention is not intended to be so limited. Alternatively, the LCD frame frequencies may be expressed by an average frame frequency (e.g., an average between the minimum and maximum frame frequencies), and a difference between the minimum or maximum frame frequency and the frequency average. In the former case, it is possible to derive a prescribed frame frequency or an optimal frame frequency from the minimum and maximum frame frequencies in accordance with selected methods. In the latter case, the frequency average may be selected as a prescribed frame frequency or an optimal frame frequency of the LCD.

As shown in FIG. 3, a microcomputer 20*a* of the notebook computer, to which embodiments of the present invention can be applied, preferably has the functionality described above with respect to the microcomputer 20. Further, the microcomputer 20*a* preferably controls the PWM frequency of an inverter adapted to control the brightness of the LCD, according to or by referring to the LCD frame frequencies such as the vertical sync frequencies.

For example, it is assumed that there are LCDs having three Vsync frequencies of 50 Hz, 56 Hz, and 60 Hz, and the LCDs are mounted to notebook computers of the same model. In this case, the Vsync frequencies included in the EDID recorded in the EEPROM of the LCD can be used as a parameter for controlling the PWM frequency of the LCD.

Setting of a desired or optimal PWM frequency generating reduced or substantially no frequency interference may be achieved using the expression "PWM frequency=Vsync*n−m" or the expression "PWM frequency=Vsync*n+m". As an example, where the expression "PWM frequency=Vsync*n−m" is used, and the values of n and m are set to 4 and 30 (e.g., n=4 and m=30), respectively, the optimal PWM frequency of the LCDs is 170 Hz in the case of "Vsync=50 Hz" (e.g., PWM=50*4−30=170), 190 Hz in the case of "Vsync=56 Hz" (e.g., PWM=56*4−30=190), and 210 Hz in the case of "Vsync=60 Hz" (e.g., PWM=60*4−30=210).

The information obtained in accordance with the above-described process is preferably determined by or supplied to a PWM generating circuit (e.g., microcomputer 20*a*), which in turn, generates PWM signals of different frequencies in accordance with respective Vsync frequencies of the LCDs. That is, the PWM generating circuit can output, to an inverter 33, a PWM signal having a frequency controlled to be 170 Hz for a derived value of 170, 190 Hz for a derived value of 190, or 210 Hz for a derived value of 210. The inverter 33 can apply to the light emitting element 190 of the LCD, a final output synchronized to the PWM signal having a frequency controlled in accordance with the Vsync signal of each LCD.

As described above, determination of the PWM frequency can be determined in the microcomputer 20*a*. However, the present invention is not intended to be so limited since such determinations could be performed elsewhere in the portable computer such as an inverter (e.g., the inverter 33) or a main processor.

Figure 6:
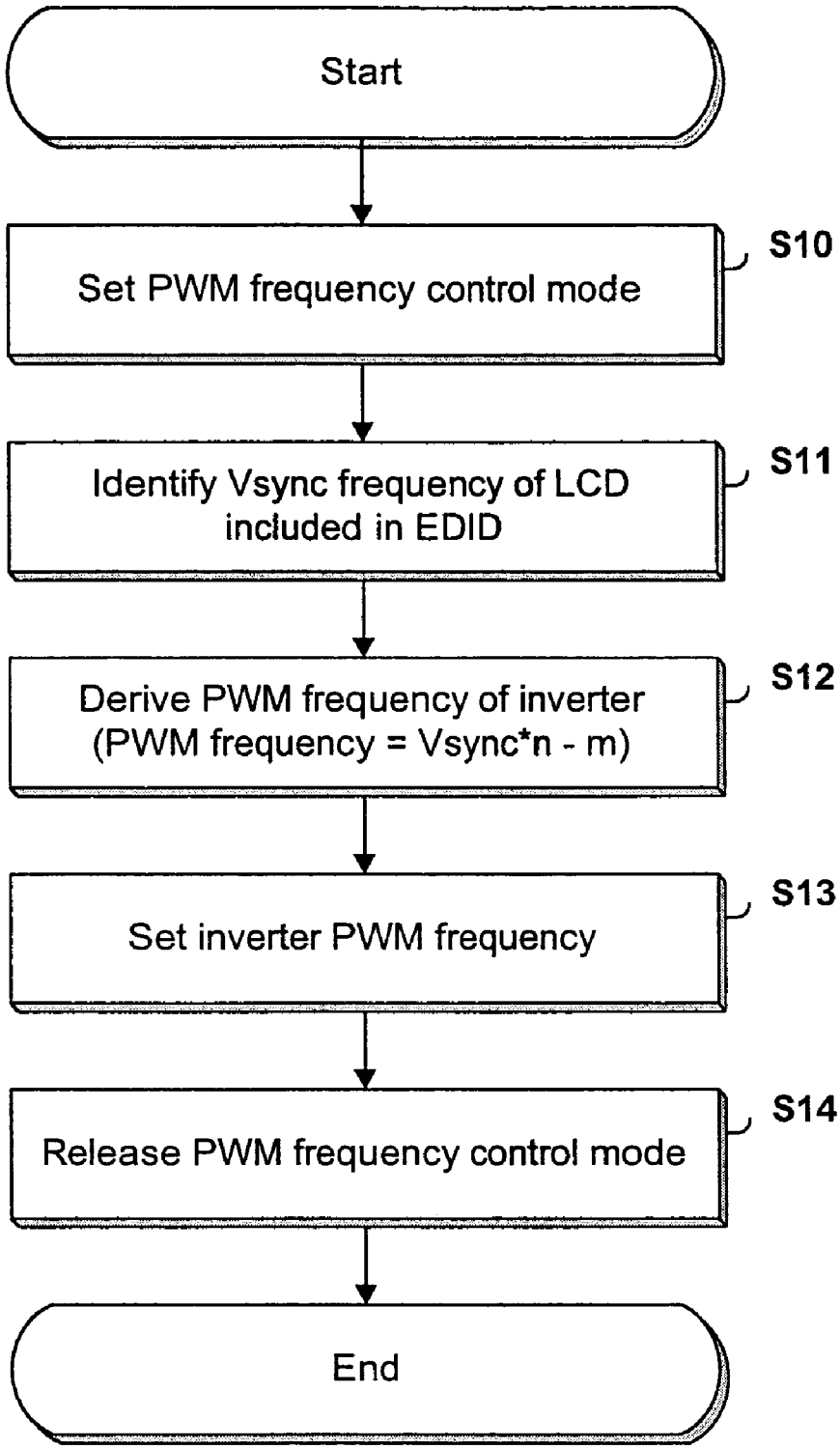
FIG. 6 is a flow chart illustrating a preferred embodiment of a method for controlling an inverter PWM frequency of an LCD in a portable computer in accordance with the present invention.

FIG. 6, is a flow chart illustrating a method for controlling an inverter PWM frequency of an LCD in a portable computer or the like in accordance with the present invention. The method shown in FIG. 6 will be described and can be applied to the portable computer of FIG. 3. However, the present invention is not intended to be so limited.

As shown in FIG. 6, after a process starts, when the current operation mode is set to a PWM frequency control mode (block S10), the microcomputer 20*a* can search the EDID to identify the Vsync frequency information included in the EDID (block S11). The microcomputer 20*a* can derive a prescribed PWM frequency of the inverter, for example using the expression "PWM frequency=Vsync*n−m" (block S12), and sets the derived PWM frequency as a selected or an optimal PWM frequency of the inverter (block S13). Thereafter, the microcomputer 20 can release the PWM frequency control mode (block S14). Such a PWM frequency control operation may be achieved by other constituent means interfaced to the microcomputer 20*a*.

Further, the microcomputer 20*a* could store a prescribed value such as an exemplary table of prescribed output PWM frequencies correlated to an LCD refresh rate as shown in FIG. 7. In this case, the PWM frequency can be derived using the stored correlated values (e.g., exemplary FIG. 7) (block S12). Further, the stored values could be managed and/or stored by other elements of the portable computer such as an inverter (e.g., inverter 33).

As described above, embodiments of apparatus and methods for controlling an inverter PWM frequency of an LCD in accordance with the present invention have various advantages. Embodiments according to the present invention can reduce or prevent generation of noise caused by interference between the vertical sync frequency of the LCD and the PWM frequency of an inverter.

Figure 8:
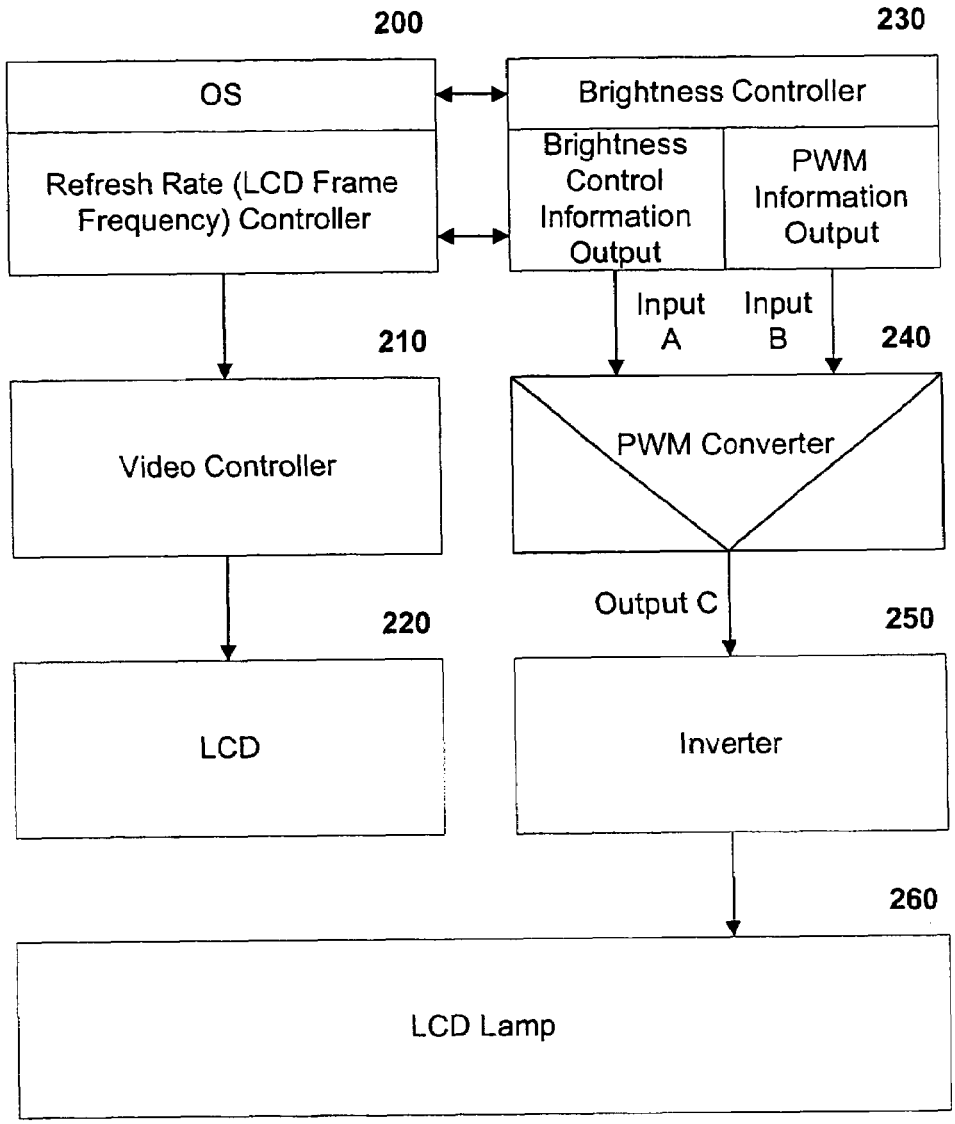
FIG. 8 is a block diagram illustrating another preferred embodiment of an apparatus that controls brightness in a display of a portable computer in accordance with the present invention.

FIG. 8 is a block diagram illustrating an apparatus configured to control brightness in a display of a portable computer in accordance with another embodiment of the present invention. The apparatus of FIG. 8 can control an inverter PWM frequency of an LCD.

The apparatus for controlling the inverter PWM frequency can include a refresh rate controller 200 programmed to optionally vary the frame frequency of an LCD. The controller 200 may be included in a part for managing video signals in an operating system. When the frame frequency of the LCD is varied, the controller 200 can output information about the varied frame frequency to a brightness controller 230.

As shown in FIG. 8, an LCD 220 may be a display unit used in a notebook computer, PDA, desktop computer or the like. The LCD 220 displays various video signals under the control of the video controller 210. The video controller 210 can adjust the frame frequency of the LCD 220 (e.g., from 60 Hz to 57 Hz, 45 Hz, etc.) under the control of the refresh rate controller 200.

Also, the apparatus for controlling the inverter PWM frequency can include a device for controlling an inverter PWM frequency to be inputted to an LCD lamp 260 preferably included in the LCD 220, in accordance with the varied frame frequency of the LCD. The LCD lamp 260 is preferably a light emitting element adapted to emit light for controlling the brightness of the LCD 220. Accordingly, the brightness of the LCD 220 varies depending on the brightness of the LCD lamp 260.

In order to control the brightness of the LCD lamp 260, the brightness controller 230 can be provided preferably in the apparatus for controlling the inverter PWM frequency shown in FIG. 8. The brightness controller 230 can receive brightness control information and the frame frequency of the LCD 220 from the refresh rate controller 200, and then outputs PWM information obtained in accordance with a PWM frequency calculation based op the frame frequency, along with the brightness control information. For example, a microcomputer or SMSC microprocessor may be used for the brightness controller 230.

That is, the control of the LCD lamp 260 in the embodiment of FIG. 8 is not performed in the refresh rate controller 200, which is preferably a main control unit, but performed in the brightness controller 230. Such a control configuration is preferably employed because most computers including notebook computers can be equipped with separate controllers for controlling peripheral devices such as a display unit and a keyboard, respectively. However, the brightness controller and refresh rate controller may be implemented with a single controller, for example, only in terms of the control for the LCD lamp.

Preferably, the PWM information must be set to enable a PWM converter to output a selected or an optimal PWM frequency corresponding to the PWM information inputted thereto. Where the variable range of a PWM frequency is set to a range of 150 to 300 Hz in an embodiment, the PWM converter can be adapted to generate a PWM frequency variation of 0.5 Hz per 0.01 V of the PWM information. Then, the PWM information can be composed to output a value range of 3 V such as between 0 V and 3 V. However, the present invention is not intended to be so limited.

The brightness controller 230 can output brightness control information and PWM information to a PWM converter 240. The PWM converter 240 can output to an inverter 250 or the like, a PWM signal having a PWM frequency varied to correspond to the PWM information and an on-time duty corresponding to the brightness control information. The inverter 250 preferably supplies a supply voltage to the LCD lamp 260 while switching the supply voltage in accordance with the frequency-varied PWM signal.

In the embodiment for controlling the inverter PWM frequency shown in FIG. 8, the PWM converter 240 is separated from the inverter 250. However, the PWM converter 240 may be configured to be included in the inverter 250. Such a configuration may be achieved by incorporating the configuration of the PWM converter 240 in a circuit of the inverter 250.

Figure 9:
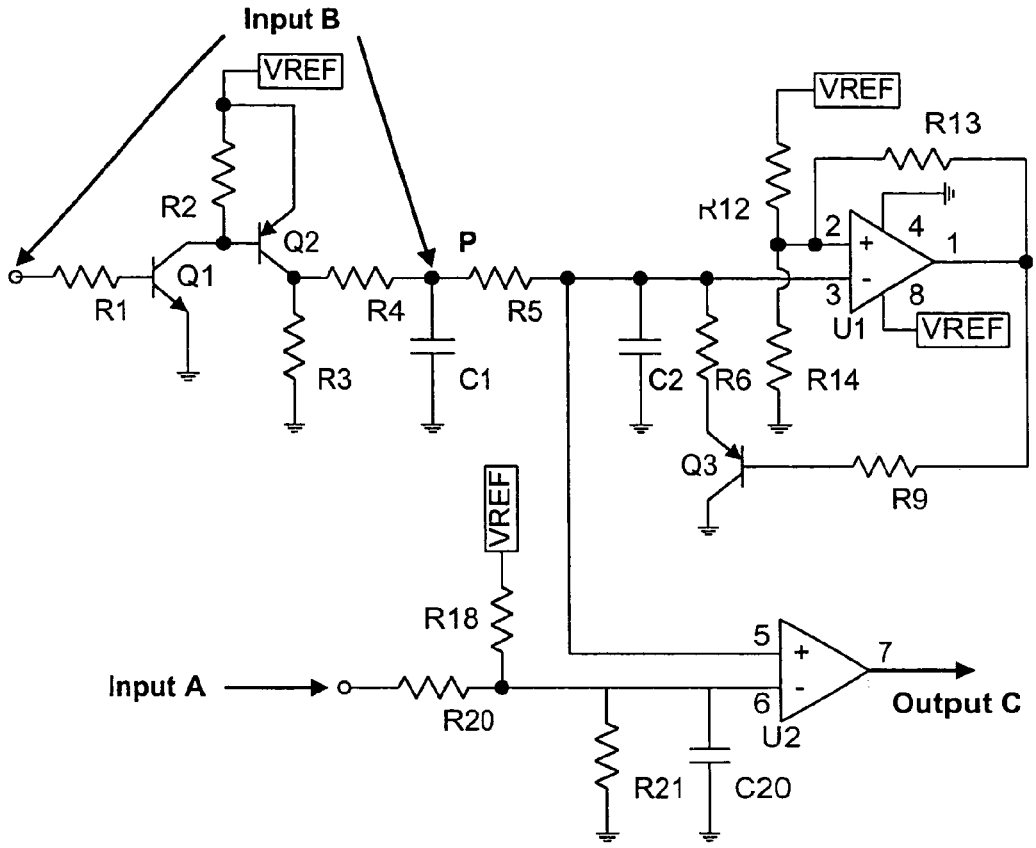
FIG. 9 is a circuit diagram illustrating a preferred embodiment of a PWM converter included in the apparatus of FIG. 8.

As shown in FIG. 9, an embodiment of a PWM converter 240 according to the present invention will now be described. As shown in FIG. 9, the PWM converter will be described with reference to and can be used as the PWM converter 240. However, the present invention is not intended to be so limited.

In the circuit configuration of the PWM converter of FIG. 9, a level shift circuit adapted to level up an input voltage by a desired level can be coupled to an input terminal to which PWM information is inputted. The level shift circuit can include an NPN type transistor Q1, a PNP type transistor Q2, and resistors R1, R2, R3, and R4 coupled to respective terminals of the transistors Q1 and Q2. A capacitor C1 can be to a node P, that is, an output terminal of the level shift circuit. An oscillator can also be coupled to the node P.

In accordance with the embodiment of the PWM converter of FIG. 9, PWM information inputted to the input terminal of the level shift circuit can be leveled up by a desired voltage level so that it is used in a signal processing operation of the oscillator. Where PWM information is inputted to the node P, it can be directly used in the signal processing operation of the oscillator.

The, oscillator, which can be coupled to the node P via a resistor R5, can include an OP amplifier U1, and resistors R12, R13, and R14 for distributing a voltage applied to an input terminal of the OP amplifier U1. The OP amplifier U1 can have an output terminal coupled to a PNP type transistor Q3 via a resistor R9. The OP amplifier U1 can also have an inverting terminal coupled to the node P via the resistor R5 and coupled to a grounded capacitor C2. A resistor R6 can be coupled between the inverting terminal of the OP amplifier U1 and the transistor Q3.

The oscillator is preferably adapted to generate an oscillating frequency varying depending on the PWM information. The transistor Q3 can be used to form a discharge loop for rapidly dropping the charge voltage of the capacitor C2 when the saw tooth wave generated from the oscillator is dropped to a low level.

The PWM information applied to the node P can be inputted to one input terminal of the OP amplifier U2. The OP amplifier U2 can receive brightness control information at the other input terminal thereof. The brightness control information can be inputted to the OP amplifier U2 via resistors R18 and R20 for voltage distribution, a grounded resistor R21, and a capacitor C20. The OP amplifier U2 preferably serves as a comparator.

Operations of the embodiment of the apparatus for controlling brightness of a display (e.g., the inverter PWM frequency of the LCD) shown in FIG. 8 will be described. Portable appliances such as notebook computers and PDAs can employ a method in which the frame frequency of an LCD is variable in accordance with the environment of a system where the LCD is used. However, problems and disadvantages can occur in the procedure of varying the frame frequency of the LCD. In embodiments according to the present invention, in association with such an LCD frame frequency control, the inverter PWM frequency for controlling the brightness of an LCD lamp is correspondingly controlled. Preferably, the inverter PWM frequency can be automatically controlled or directly controlled to compensate for the environment of the system.

In accordance with embodiments of the present invention, an environment of a system where the LCD 220 is used is first identified. For the identification of the system environment, it is determined whether system interference or noise is affecting or interacting with the LCD frame frequency. System noise can include interference by a power adaptor, any frequency generator in the portable computer, electronic component or connection interference or the like. For example, apparatus for controlling brightness can detect whether AC power or a battery is coupled as a power source. Preferably, the portable computer, for example, the microcomputer 20*a* can identify the system environment, and then sends information about the identified system environment to the CPU 10 via a bus.

Where it is determined that the frame frequency of the LCD 220 is required to be adjusted under the current system environment (e.g., to reduce system interference or noise), the refresh rate controller 200 can control the video controller 210 to vary the frame frequency of the LCD 220 (e.g., from 60 Hz to 57 Hz or from 57 Hz to 45 Hz). The refresh rate controller 200 can output to the brightness controller 230 the varied frame frequency along with brightness information.

The brightness controller 230 can calculate, based on the frame frequency received from the controller 200, a PWM frequency that will not interfere with the frame frequency, and process the calculated PWM frequency to produce PWM information (e.g., DC voltage level or on-time duty control signal of a certain or selected frequency). The PWM information generated from the brightness controller 230 can be outputted to the PWM converter 240. The brightness controller 230 preferably processes the brightness information received from the controller 200, in association with the calculated PWM frequency, such that it maintains a constant on-time duty to produce brightness control information (e.g., DC voltage level or on-time duty control signal of a certain frequency). The brightness control information generated from the brightness controller 230 can be outputted to the PWM converter 240.

The PWM converter 240 can generate a PWM signal (e.g., reference sync signal) required to enable the inverter 250 to generate a signal for driving the LCD lamp 260. The embodiment of the PWM converter of FIG. 9 can operate as the PWM converter 240. However, the present invention is not intended to be so limited. The PWM signal (e.g., reference sync signal) can have a frequency determined by the PWM information outputted from the brightness controller 230, and an on-time duty determined by the brightness control information outputted from the brightness controller 230.

In the embodiment of FIG. 9, the PWM converter can receive input signals A and B to output an output signal to the inverter 250. As shown in FIG. 9, the input signal B can be leveled up by a predetermined level through the level shift circuit, and then applied to the node P. The oscillator can generate an oscillating signal having an oscillating frequency varied based on the signal applied to the node P. The oscillating signal can be received at a non-inverting terminal of the OP amplifier U2 and the input signal A at its inverting terminal. The OP amplifier U2 can compare the two received signals with each other to output the result of the comparison.

The PWM converter 240 may be designed such that the OP amplifier U1 outputs a signal having a frequency varying between 150 Hz and 300 Hz when the input signal B has a voltage level of 0 to 3 V. In this case, the frequency of the output signal has a variation range of 150 Hz, so that it can vary 0.5 Hz for a variation of 0.01 V in the input signal B. That is, the output signal frequency becomes 150 Hz for the input signal B of 0 V, 151 Hz for 0.02 V, 152 Hz for 0.04 V, . . . , 200 Hz for 1 V, 201 Hz for 1.02 V, . . . , 250 Hz for 2 V, 251 Hz for 2.02 V, . . . , 299 Hz for 251 Hz, and 300 Hz for 3V.

Further, where the frame frequency of the LCD 220 varies from 60 Hz to 57 Hz or from 57 Hz to 45 Hz, the selected or optimal PWM frequency for brightness control that will not interfere with the frame frequency can be determined as follows:

for 60 Hz, $$\{(60\times1)+(60/2)\}=90,\ \{(60\times2)+(60/2)\}=150,$$

$$\{(60\times3)+(60/2)\}=210,\ \{(60\times4)+(60/2)\}=270,$$

$$\{(60\times5)+(60/2)\}=330,$$

for 57 Hz, $$\{(57\times1)+(57/2)\}=85.5,\ \{(57\times2)+(57/2)\}=142.5,$$

$$\{(57\times3)+(57/2)\}=199.5,\ \{(57\times4)+(57/2)\}=256.5,$$

$$\{(57\times5)+(57/2)\}=313.5,$$

for 45 Hz, $$\{(45\times1)+(45/2)\}=67.5,\ \{(45\times2)+(45/2)\}=112.5,$$

$$\{(45\times3)+(45/2)\}=157.5,\ \{(45\times4)+(45/2)\}=202.5,$$

$$\{(45\times5)+(45/2)\}=247.5,$$

Since the variation range of the PWM frequency can be set to be between 150 Hz and 300 Hz, the optimal frequency selectable in the frequency range may be 270 Hz for the frame frequency of 60 Hz, 256.5 Hz for 57 Hz, and 202.5 Hz for 45 Hz.

Also, the input DC voltage level required to enable the oscillator to output such an optimal PWM frequency can be calculated (e.g., 2.4 V for the frame frequency of 60 Hz, 2.13 V for 57 Hz, and 1.05 V for 45 Hz). Accordingly, the input DC voltage level can correspond to the PWM information to be inputted to the PWM converter 240. This DC voltage level may be directly outputted from the brightness controller 230. Alternatively, the DC voltage level may be outputted in the form of a PWM frequency on-time duty control signal. In the latter case, the control signal can be used after being DC-rectified. The brightness controller 230 can process the PWM information in accordance with the varied LCD frame frequency received from the refresh rate controller 200, and output the processed PWM information to the PWM converter 240.

Figure 10:
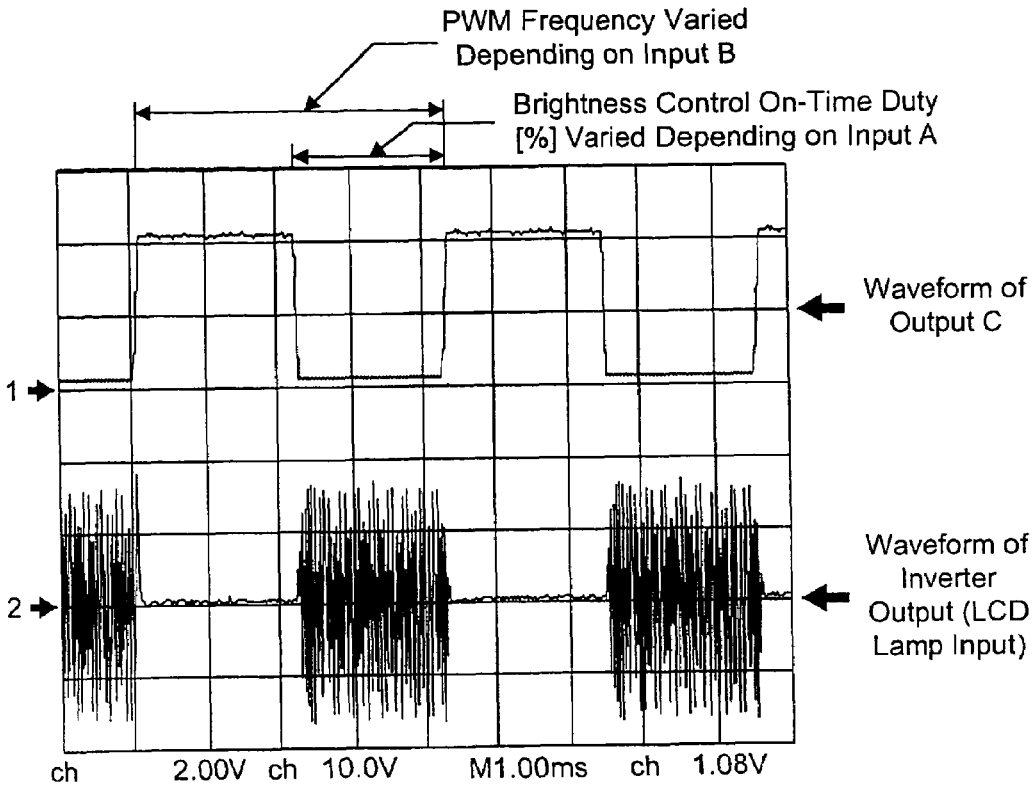
FIG. 10 is a waveform diagram of signals outputted from respective elements of the apparatus of FIG. 8.

In accordance with such procedures, the frame frequency of the LCD and the PWM frequency of the inverter can be controlled while being associated with each other. That is, where the frame frequency of the LCD display 220 is 60 Hz, the brightness controller 230 can output 2.4 V as PWM information. The PWM converter 240 receives the voltage of 2.4 V and can output a PWM signal of 270 Hz. The PWM signal is inputted to the inverter 250 which, in turn, can output to the LCD lamp 260, a signal having a waveform as shown in FIG. 10 in sync with the waveform of the PWM signal inputted from the PWM converter 240. In this case, the value representing the interference degree between the PWM signal and frame frequency, that is, f, is 30 (i.e., f=30) (e.g., there is a gap of 30 Hz between the PWM frequency of 270 Hz and the 4th multiple of 60 Hz, that is, 240 Hz). Accordingly, this case satisfies the condition of "f>15", so that the LCD lamp 260 is controlled in brightness in a stable operating state.

Further, where the frame frequency of the LCD display 220 is 57 Hz, the brightness controller 230 can output 2.13 V as PWM information. The PWM converter 240 receives the voltage of 2.13 V, and can output a PWM signal of 256.5 Hz. The PWM signal is inputted to the inverter 250 which, in turn, can output to the LCD lamp 260, a signal having a waveform shown in FIG. 10 in sync with the waveform of the PWM signal. In this case, the value f is 28.5 (f=28.5) (e.g., there is a gap of 28.5 Hz between the PWM frequency of 256.5 Hz and the 5th multiple of 57 Hz, that is, 285 Hz). Accordingly, this case satisfies the condition of "f>15", so that the LCD lamp 260 is controlled in brightness in a stably operating state.

In addition, where the frame frequency of the LCD display 220 is 45 Hz, the brightness controller 230 can output 1.05 V as PWM information. The PWM converter 240 receives the voltage of 1.05 V and can output a PWM signal of 202.5 Hz. The PWM signal is inputted to the inverter 250 which, in turn, can output to the LCD lamp 260, a signal having a waveform shown in FIG. 10 in sync with the waveform of the PWM signal. In this case, the value f is 22.5 (f=22.5) (e.g., there is a gap of 22.5 Hz between the PWM frequency of 202.5 Hz and the 5th multiple of 45 Hz, that is, 225 Hz). Accordingly, this case satisfies the condition of "f>15", so that the LCD lamp 260 is controlled in brightness in a stable operating state.

Alternatively, the brightness controller 230 or the microcomputer 20*a* could store information such as an exemplary table of prescribed DC voltages correlated to an LCD refresh rate to select a desired or optimum PWM frequency as shown in FIG. 11. In this case, a selected PWM frequency can be derived using the stored correlated values (e.g., exemplary FIG. 11). Further, the stored values could be managed and/or stored by other elements of the portable computer such as an inverter (e.g., inverter 33).

Thus, the apparatus of FIG. 8 configured to control brightness in a display of a portable computer and methods thereof according to the present invention can implement a digital mode inverter for detecting a varied frame frequency of an LCD, and directly or automatically control a PWM frequency of an inverter, adapted to control the brightness of the LCD, such that it does not interfere with the varied frame frequency. Accordingly, a device such as a portable computer containing an LCD can operate the LCD in a variable frame frequency mode according to a system environment.

As described above, embodiments of an apparatus and method for controlling an inverter PWM frequency of an LCD in accordance with the present invention have various advantages. Embodiments can control the inverter PWM frequency for brightness control in accordance with a variation in the frame frequency of the LCD to reduce or prevent interference between the frame frequency and the inverter PWM frequency. Thus, a degradation in picture quality can be reduced or prevented from occurring in the LCD. Further, embodiments can use, as the inverter PWM frequency, a variable frequency as well as a fixed frequency and PWM frequencies can be provided to satisfy respective characteristics of diverse LCDs and/or system environments while using a single inverter. The PWM frequencies can be determined either directly or indirectly (e.g., using determined voltage) in a controller or a PWM converter of a portable computer. In addition, embodiments according to the present invention can be applied to any product using an LCD, for example, a portable appliance such as a notebook computer or a PDA, a desktop computer, or a mobile display.

Any reference in this specification to "the embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. Furthermore, for ease of understanding, certain method procedures may have been delineated as separate procedures; however, these separately delineated procedures should not be construed as necessarily order dependent in their performance. That is, some procedures may be able to be performed in an alternative ordering, simultaneously, etc.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An apparatus for controlling pulse width modulation (PWM) frequency of a liquid crystal display (LCD), comprising:

control means for changing an LCD frame frequency of the LCD based on a system environment, and outputting information based on the changed LCD frame frequency for an LCD inverter, wherein the system environment comprises electronic interference or noise;

PWM converting means for generating a PWM signal for the LCD inverter based on the information received from the control means; and driving means for converting an input voltage into a signal having a waveform synchronized to the PWM signal received from the PWM converting means.

2. The apparatus of claim 1, wherein the system environment comprises detected electronic interference.

3. The apparatus of claim 2, wherein the detected electronic interference results from one of an AC voltage provided to the apparatus or a voltage adaptor coupled to the apparatus.

4. The apparatus of claim 3, wherein the detected electronic interference results from a plurality of various signals affecting the LCD frame frequency.

5. The apparatus of claim 2, wherein the apparatus comprises a video controller to change a refresh rate to compensate for the detected electronic interference.

6. The apparatus of claim 1, wherein the control means comprises:

refresh rate controlling means for controlling the LCD frame frequency and outputting the controlled frame frequency information along with brightness control information for an LCD lamp of the LCD; and brightness controlling means for calculating PWM information based on the controlled frame frequency information received from the refresh rate controlling means, and outputting the calculated PWM information along with the brightness control information received from the refresh rate controlling means.

7. The apparatus of claim 6, further comprising:

video controlling means for controlling a video signal to be outputted to the LCD based on the frame frequency information received from the refresh rate controlling means.

8. The apparatus of claim 6, wherein the refresh rate controlling means varies the frame frequency of the LCD according to the system environment.

9. The apparatus of claim 1, wherein the information is a value corresponding to a frequency not interfering with the LCD frame frequency.

10. The apparatus of claim 9, wherein the information is a value obtained by calculating PWM information based on the frame frequency, and transforming the calculated PWM information in accordance with a predetermined rate.

11. The apparatus of claim 10, wherein the PWM information is outputted in the form of a DC level.

12. The apparatus of claim 9, wherein the information is a value obtained by multiplying the frame frequency by 4.5, and transforming a resulant value in accordance with a predetermined rate.

13. The apparatus of claim 9, wherein the PWM converting means transforms the received information having a value within a predetermined range, in accordance with a predetermined rate so that the PWM signal has a frequency within a predetermined frequency range.

14. The apparatus of claim 13, wherein the PWM signal generated by the driving means is based on brightness control information received from the control means, wherein the PWM converting means controls an on-time duty of the PWM signal based on the received brightness control information.

15. The apparatus of claim 1, wherein the PWM converting means comprises:

frequency outputting means for outputting a signal having a frequency corresponding to the information received from the control means; and comparing means for comparing the signal outputted from the frequency outputting means with brightness control information received from the control means to output the PWM signal.

16. The apparatus of claim 15, wherein the PWM converting means comprises level shift means for leveling up the PWM information received from the control means by a predetermined level.

17. The apparatus of claim 1, further comprising:

the LCD for displaying a video signal in accordance with the frame frequency; and an LCD lamp for back lighting of the LCD, wherein the driving means comprises an inverter.

18. The apparatus of claim 17, wherein the LCD is used in a portable appliance.

19. A method for controlling an inverter pulse width modulation (PWM) frequency of a liquid crystal display (LCD), comprising:

identifying a frame frequency of the LCD by selecting one of a plurality of frame frequencies based on a system environment wherein the a system environment comprises electronic interference or noise, and outputting PWM information based on the identified frame frequency; and generating a PWM signal, based on the PWM information and brightness control information for an LCD lamp.

20. The method of claim 19, wherein the system environment comprises detected electronic interference, and wherein the detected electronic interference results from one of an AC voltage provided to the system or a voltage adaptor coupled to the system.

21. The method of claim 19, further comprising converting an input voltage received from a power source into a signal having a waveform synchronized to the generated PWM signal.

22. The method of claim 21, wherein the PWM information is a value corresponding to a frequency that does not substantially interfere with the frame frequency, the non-interfering frequency corresponding to a frequency of the PWM signal to which the input voltage is converted.

23. The method of claim 22, wherein the PWM information is a value obtained by multiplying the frame frequency by 4.5, and transforming the resultant value in accordance with a predetermined rate, and wherein the PWM information is outputted in the form of a DC level.

24. The method of claim 19, wherein the generating comprises transforming the PWM information having a value within a predetermined range, in accordance with a predetermined rate for generating a PWM signal having a frequency within a predetermined frequency range.

25. The method of claim 24, wherein the brightness control information is used to control an on-time duty of the PWM signal.

26. The method of claim 19, wherein the generating comprises:

leveling up the PWM information by a predetermined level;

outputting a first signal having a frequency corresponding to the leveled PWM information; and comparing the first signal with the brightness control information to output the PWM signal.

27. The method of claim 19, further comprising varying the frame frequency of the LCD.

28. The method of claim 27, wherein the frame frequency is varied under the system environment in which electric power is supplied only from a battery.

29. An apparatus configured to control an inverter pulse width modulation (PWM) frequency of a liquid crystal display (LCD), comprising:

a controller configured to select one of a plurality of different frame frequencies of the LCD based on a system environment wherein the a system environment comprises electronic interference or noise and to output PWM information based on the selected frame frequency for an LCD lamp; and a PWM converter configured to generate a PWM signal based on the PWM information.

30. The apparatus of claim 29, further comprising an inverter configured to convert an input voltage into a signal having a waveform synchronized to the PWM signal received from the PWM converter, wherein the PWM signal is based on brightness control information for the LCD lamp received from the controller.

31. A method for controlling an inverter pulse width modulation (PWM) frequency of a liquid crystal display (LCD), comprising:

identifying a frame frequency of the LCD by selecting one of a plurality of frame frequencies based on a system environment wherein the a system environment comprises electronic interference or noise, and outputting PWM information based on the identified frame frequency; and generating a PWM signal, based on the PWM information and brightness control information for an LCD lamp, wherein generating the PWM signal comprises:

leveling up the PWM information by a predetermined level;

outputting a first signal having a frequency corresponding to the leveled PWM information; and comparing the first signal with the brightness control information to output the PWM signal.

* * * * *